US009655429B2

(12) United States Patent
Park

(10) Patent No.: US 9,655,429 B2
(45) Date of Patent: May 23, 2017

(54) METALLIC FOIL NAIL APPLIQUÉS

(71) Applicant: Fa Young Park, Clifton, NJ (US)

(72) Inventor: Fa Young Park, Clifton, NJ (US)

(73) Assignee: Park Global Holdings, LLC, Clifton, NJ (US)

( * ) Notice: Subject to any disclaimer, the term of this patent is extended or adjusted under 35 U.S.C. 154(b) by 248 days.

(21) Appl. No.: 13/859,563

(22) Filed: Apr. 9, 2013

(65) Prior Publication Data

US 2013/0220355 A1 Aug. 29, 2013

Related U.S. Application Data

(63) Continuation-in-part of application No. 11/126,862, filed on May 11, 2005, now abandoned.

(60) Provisional application No. 61/621,887, filed on Apr. 9, 2012, provisional application No. 61/799,386, filed on Mar. 15, 2013.

(51) Int. Cl.
*A45D 29/00* (2006.01)

(52) U.S. Cl.
CPC ..... *A45D 29/001* (2013.01)

(58) Field of Classification Search
None
See application file for complete search history.

(56) References Cited

U.S. PATENT DOCUMENTS 4,903,840 A * 2/1990 So ..... 206/581
5,985,951 A * 11/1999 Cook ..... A61K 8/731 424/401
6,296,836 B1 * 10/2001 Engler ..... 424/61
7,861,730 B2 1/2011 Jordan
2005/0150508 A1 7/2005 Downs et al.
2005/0199253 A1 9/2005 Fiore et al.
2005/0255061 A1 11/2005 Park
2008/0276951 A1 11/2008 Park
2010/0212681 A1 8/2010 Park

FOREIGN PATENT DOCUMENTS

WO WO 2005/070048 * 8/2005
WO WO 2005/112873 A2 12/2005

OTHER PUBLICATIONS

International Search Report and Written Opinion for International Patent Application No. PCT/US2013/035817, mailed Jul. 31, 2013.

* cited by examiner

*Primary Examiner* — Craig Ricci
(74) *Attorney, Agent, or Firm* — Carrie Marlene Stroup

(57) ABSTRACT

A multi-layered foil appliqué for decorating nails is cut from a laminated sheet having the following layers: a first adhesive layer residing on a releasable substrate; a base coat residing on the first adhesive layer; a UV-curable adhesive layer residing on the base coat; a foil layer residing on the UV-curable adhesive layer; and a top coat residing on the foil layer. The foil is applied to the UV-curable adhesive layer by contact between the metallic side of a metallized plastic sheet and the adhesive before the adhesive is cured. The bottom coat and top coat are formed from organic solvent-based nail enamels. Sufficient solvent remains in the appliqué to keep it stretchable before use. Residual solvent evaporates after the appliqué is applied to a user's nail.

12 Claims, 2 Drawing Sheets

METALLIC FOIL NAIL APPLIQUÉS

CROSS-REFERENCE TO RELATED APPLICATIONS

The present application is a continuation-in-part of U.S. patent application Ser. No. 11/126,862, filed May 11, 2005, and claims the benefit of U.S. Provisional Patent Application No. 61/621,887, filed Apr. 9, 2012, and U.S. Provisional Patent Application No. 61/799,386, filed Mar. 15, 2013, all of which aforesaid applications are incorporated by reference herein in their entireties.

FIELD OF THE INVENTION

The present invention relates to the field of nail polish and nail decorations, and, more specifically, to nail appliqués for adorning a fingernail or toenail.

BACKGROUND OF THE INVENTION

The use of an instant fingernail coating product whereby nail polish is applied to a fingernail by adhesively securing to it a dry form of nail polish has become a popular method of providing a manicure. Such products, also known as "nail appliqués", allow a user to rapidly decorate finger or toe nails with colors, designs or images, or with metallic sheens. Such sheens may be provided through the use of nail appliqués containing metallic foils or films (hereinafter, "foil appliqués").

SUMMARY OF THE INVENTION

A nail appliqué according to an embodiment of the present invention includes a self-adhesive nail appliqué having a first adhesive layer; a partially-cured base coat on the first adhesive layer; a second adhesive layer on the base coat; a metallic foil layer on the second adhesive layer; and a partially-cured top coat on the metallic foil layer. In some embodiments, the second adhesive layer cures by exposure to ultraviolet radiation. In some other embodiments, the nail appliqué is stretchable and the base coat, the second adhesive layer, and the top coat are stretchable at substantially the same rates as each other. In yet other embodiments, the base coat, the second adhesive layer, and the top coat are coextensive with each other in an uncured state, a partially-cured state, and a cured state. In further embodiments, the metallic foil layer is a single layer coextensive with the second adhesive layer.

A method of manufacturing a self-adhesive nail appliqué according to an embodiment of the present invention includes the steps of forming a first adhesive layer; forming a partially-cured base coat on the first adhesive layer; forming a second adhesive layer on the base coat; forming a metallic foil layer on the second adhesive layer; and forming a partially-cured top coat on the metallic foil layer. In some embodiments, the step of forming the second adhesive layer includes the step of exposing the adhesive to ultraviolet radiation after the step of forming the metallic foil layer.

BRIEF DESCRIPTION OF THE DRAWINGS

For a more complete understanding of the present invention, reference is made to the following detailed description of the invention considered in conjunction with the accompanying drawings, in which.

DETAILED DESCRIPTION OF THE INVENTION

In some embodiments, the present invention includes a multi-layered nail appliqué having metallic foil or film as at least one of the layers ("foil appliqué). In a method according to an embodiment of the present invention, the foil appliqué is built up in a layer-by-layer fashion on top of a releasable substrate. The foil appliqué is soft and stretchable to cover a user's fingernail or toenail, but is hardened (e.g., with the aid of a user's body heat, or at room temperature) when it is applied to the fingernail or toe nail. For the purposes of the present disclosure, fingernails and toenails are referred to, collectively, as "nails".

Figure 1:
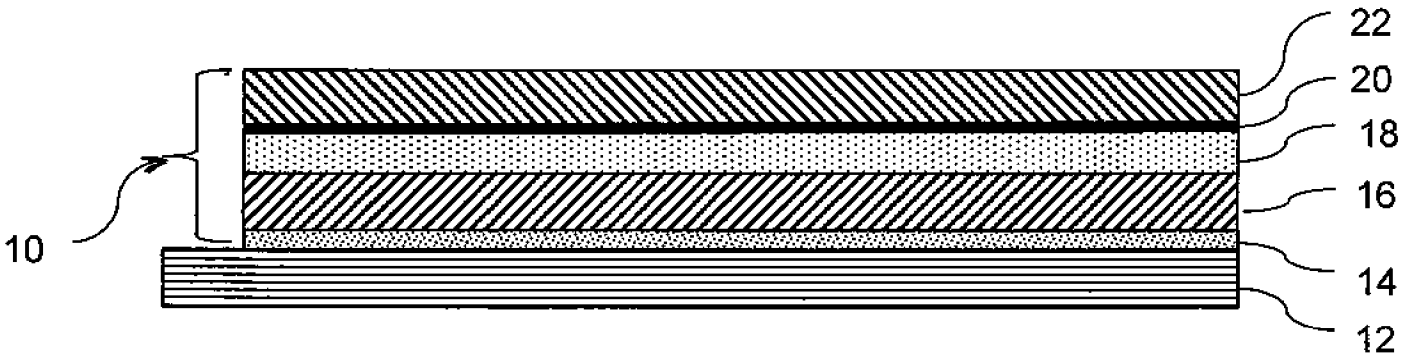
FIG. 1 is a schematic diagram of a vertical cross-section of a multilayer foil nail appliqué on a removable substrate according to an embodiment of the present invention.

FIG. 1 is a schematic diagram of a vertical cross-section of foil appliqué 10 according to an embodiment of the present invention. In one embodiment, the foil appliqué 10 is provided adhered to a removable substrate 12 from which the foil appliqué 10 can be detached. Turning to FIG. 1, a foil appliqué 10 according to an embodiment of the present invention is a multi-layer structure including: a first adhesive layer 14, comprising an adhesive suitable for adhering the foil appliqué to the nail and removably adhering the foil appliqué to the substrate 12; a base coat 16 comprising nail enamel residing on the first adhesive layer 14; a second adhesive layer 18 residing on the base coat 16; a layer of metallic foil or film 20 residing on the second adhesive layer 18; and a top coat of a clear nail enamel 22 covering the metallic foil or film. The second adhesive layer 18 includes an adhesive substance that may be cured (e.g., gelled and/or hardened) by exposure to ultraviolet radiation (also referred to as "UV radiation"), and is also referred to herein as a "UV adhesive layer".

Turning now to the materials that may be used to form the layers of the foil appliqué 10, it may first be noted that suitable materials for each of the adhesive or nail enamel layers 14, 16, 18, 22 may be obtained commercially, or may be developed on a custom basis using materials and methods known in the art. In embodiments of the invention, the aforesaid layers should maintain their dimensional stability during curing in the manufacturing process and/or while on the user's nail. If the dimensions of the layers do change, such changes should occur to a similar degree across each of the layers 14, 16, 18, 22 such that the layers 14, 16, 18, 22 remain co-extensive (i.e., cover each other to the same extent) to avoid wrinkling or distortion of the foil appliqué, or, more specifically, the foil layer. The dimensional stability of the metallic foil or film layer 20 will typically be less of a concern for reasons discussed elsewhere herein. The materials used for the various layers should also, when working together, provide a structure having physically properties (e.g., stretchability, flexibility, tear resistance, etc.) that are desired in the final product (i.e., the foil appliqué), and should stretch or flex without wrinkling the appliqué or the foil layer. These properties may be similar to those of certain nail enamel appliqués presently known in the art, such as those described in U.S. patent application Ser. No. 11/126,862, filed May 11, 2005, (published as U.S.

Patent Publication No. 2005/0255061, published Nov. 17, 2005), the entire disclosures of both of which are incorporated by reference herein.

Turning to the first adhesive layer 14, the adhesive used therein should be able to adhere firmly to a nail when cured. The adhesive may be applied to the substrate 12 as a liquid or melted from a hardened state, and may contain solvents that volatilize readily at a human body temperature or below, such as low-molecular-weight acetates or alcohols. The adhesive of the first adhesive layer 14 should also be of a type that will release readily from the substrate 12, which may be made of a material, such as a thin sheet of silicon-coated release liner paper or aluminum laminate plastic film. A suitable thickness for the first adhesive layer in some embodiments of the present invention would be about 10-15% of the total thickness of the finished appliqué. Adhesives and substrates suitable for use in the present invention are similar to those discussed further in the aforesaid U.S. patent application Ser. No. 11/126,862 with regard to nail enamel appliqués. Exemplary adhesives suitable for the present invention include acrylic co-polymer adhesives.

Turning to the base coat 16 and top coat 22, it should be noted that, in embodiments of the present invention, these coats may be formed from commercially-available or custom-made nail enamels. In one embodiment of the present invention, the top coat 22 is made from a clear (e.g., transparent or translucent) enamel, so that the foil layer 20 may be seen, and the finished appliqué 10 has the desired metallic color and sheen. In some embodiments, the clear coat may include a color, or may include additives (e.g., glitter or mica chips) to enhance the appearance of the finished appliqué. In such embodiments, the top coat should be formulated so that the foil layer remains visible. The base coat 16 may also be made of a clear enamel, but its purpose is to provide a mechanical barrier between the first adhesive layer 14 and the UV adhesive layer 18, and also provide a smooth surface for application of the UV adhesive layer 18. Suitable thicknesses for the top and bottom coats 16, 22 include those in the range of about 35-45% of the total thickness of the finished appliqué. The nail enamel may be organic solvent-based, or aqueous-based, or be of a UV-curable type. Desirable physical properties and compositions of the nail enamels will depend on such factors as the method of applying the respective base or top layers 16, 22, or the temperature at which the layer 16, 18 is to be cured. Organic solvent-based nail enamels having viscosities of 1500-4000 centipoise (60 rpm) at room temperature (e.g., about 20° C.) may have particular utility in the present invention. Nail enamel properties and formulations are discussed in the aforesaid U.S. patent application Ser. No. 11/126,862 with regard to nail enamel appliqués, any may readily be adapted by those having ordinary skill in the art to produce clear coats suitable for use with the present invention.

The UV adhesive layer 18 may include any of a broad range of materials that cure to a gelled or tacky state after an initial exposure to ultraviolet light, and are non-toxic in their cured form. Numerous such materials are available commercially, and include polyurethane resins, epoxy resins, polyacrylate resins, and mixtures thereof. One such material has a composition range, by weight, of:

| | |
|---|---|
| 10-25% | Polyurethane resin; |
| 1-25% | Epoxy resin; |

-continued

| | |
|---|---|
| 1-20% | Polyacrylate resin; and |
| 1-10% | Photoinitiators and stabilizers. |

Turning to the metal foil or film layer 20, there are numerous commercially-available products that are suitable for use in the present invention. These products generally comprise a metallic film deposited on a plastic sheet (also referred to as a "metallized plastic sheet"). Such products are available in a number of metallic colors, including silver and gold, in multicolored forms, or in a holographic-finished form. Aluminum is the metal most commonly-available on plastic sheet, with polyethylene terephthalate (PET) being among the most commonly-used plastics. The metal films may have thicknesses in the range of 10-1000 nm, more typically 50-100 nm for aluminum. These thicknesses are sometimes expressed in the angstrom units (A), in which 1 nm equals 10 Å. At such thicknesses, the metallic film can readily be transferred intact onto an adhesive surface, such as that of UV adhesive layer 18 by simple contact between the film and the adhesive. The resulting foil or film layer 20 is typically porous (i.e., there are very small gaps between metallic particles), but it appears to be solid in the appliqué, and may be highly reflective. Because the metallic film is porous and so thin, it may deform (e.g., stretch) to some degree without adversely affecting the appearance of the appliqué. There are numerous cold-stamp foils suitable for use with the present invention that will be recognized by those having ordinary skill in the art and possession of the present disclosure.

In a method of fabricating a foil appliqué, such as foil appliqué 10, according to an embodiment of the present invention, a laminated sheet of material is prepared having the layered structure desired for the foil appliqué. The sheet is built up in a layer-by-layer fashion on the releasable substrate 12 by a continuous fabrication process. Such a continuous process is discussed in the aforesaid U.S. patent application Ser. No. 11/126,862 with regard to nail enamel appliqués, and suitable adaptations of this process for use in the present invention will be apparent to those having ordinary skill in the art and possession of the present disclosure.

Using foil appliqué 10 as a reference, the adhesive layer 14 is deposited directly onto the substrate 12 as a liquid or by melting a solid adhesive onto the substrate 12. Suitable means for depositing an adhesive layer onto a surface during a continuous fabrication process are known in the art. The adhesive is allowed to gel or harden, while retaining its tackiness, before the next layer (i.e., base coat 16) is applied.

Turning to base coat 16, nail enamel is applied directly to the adhesive layer 14, so as to cover the adhesive layer 14, and form a smooth surface for subsequent application of the UV adhesive layer 18. Nail enamels containing organic solvents or water may be heated to evaporate a portion of the solvents or water, thus partially curing the base coat 16. The evaporation step may also be performed at room temperature, depending on the composition of the nail enamel used and the thickness of the base coat 16. The temperature and dwell time for this process are a matter of engineering choice, as they should be coordinated with the overall process rate and the desired quality of the final product. In embodiments of the present invention, a portion of the solvent or water is allowed to remain in the enamel (i.e., the enamel is "partially-cured"), so that the base coat 16 has a desired degree of stretchability. If a UV-curable nail enamel is used, a heating step may not be needed, since the typical UV-curable enamel typically would not contain solvents or water. Instead, the enamel would be exposed to UV radiation to initiate the curing process. The duration and intensity of the exposure would depend on the formulation of the nail enamel, and would be understood by those knowledgeable in the relevant chemical art, or could be selected according to instructions provided by the manufacturer of the nail enamel.

Turning to the UV adhesive layer 18 and foil layer 20, the UV-curable mixture is applied to the surface of the base coat 16. In some embodiments of the present invention, the UV-curable mixture is not exposed to UV radiation until after the foil layer 20 is applied. In such an embodiment of the present invention, the metallic surface of a roll of metallized plastic sheet is put in contact with the UV-curable mixture using methods known in various arts (e.g., in continuous contact printing). The foil adheres to the UV-curable mixture in a porous layer and separates from the plastic sheet. This "cold stamping" process, which may be performed at room temperature, has advantages over the "hot stamping" process that is commonly used. Hot stamping requires that application of heat to the foil, which would heat the entire multilayered structure, causing the lower layers of the appliqué to dry out and, possibly, disrupting them. The hot stamping method also requires a die to transfer heat to the appliqué. Such dies often must be specially made. Neither a die nor the application of damaging degrees of heat are required for the cold stamping method used in embodiments of the present invention.

After the foil layer 20 is applied, the UV-curable mixture is exposed to UV radiation through the porous metallic foil to initiate the curing process. As discussed with respect to the UV nail enamel of some embodiments of base coat 16, the duration and intensity of the exposure would depend on the formulation of the UV-curable mixture, and would be understood by those knowledgeable in the relevant chemical art, or could be selected according to instructions provided by the manufacturer of the adhesive.

Turning to top coat 22, nail enamel is applied directly over the foil layer 20, so as to cover the foil layer 20 and the UV adhesive layer 18. The top coat 22 can include a single layer or multiple layers of nail enamel. Nail enamels containing organic solvents or water may be heated to evaporate a portion of the solvents or water, thus partially curing the top coat 22. The evaporation step may also be performed at room temperature, depending on the composition of the nail enamel used and the thickness of the top coat 22. As with the base coat 16, the temperature and dwell time for this process are a matter of engineering choice, as they should be coordinated with the overall process rate and the desired quality of the final product. In embodiments of the present invention, a portion of the solvent or water is allowed to remain in the enamel (i.e., the enamel is "partially-cured"), so that the top coat 16 has a desired degree of stretchability. If a UV-curable nail enamel is used, a heating step may not be needed, since the typical UV-curable enamel typically would not contain solvents or water. Instead, the enamel would be exposed to UV radiation to initiate the curing process. The duration and intensity of the exposure would depend on the formulation of the nail enamel, and would be understood by those knowledgeable in the relevant chemical art, or could be selected according to instructions provided by the manufacturer of the nail enamel.

Figure 2:
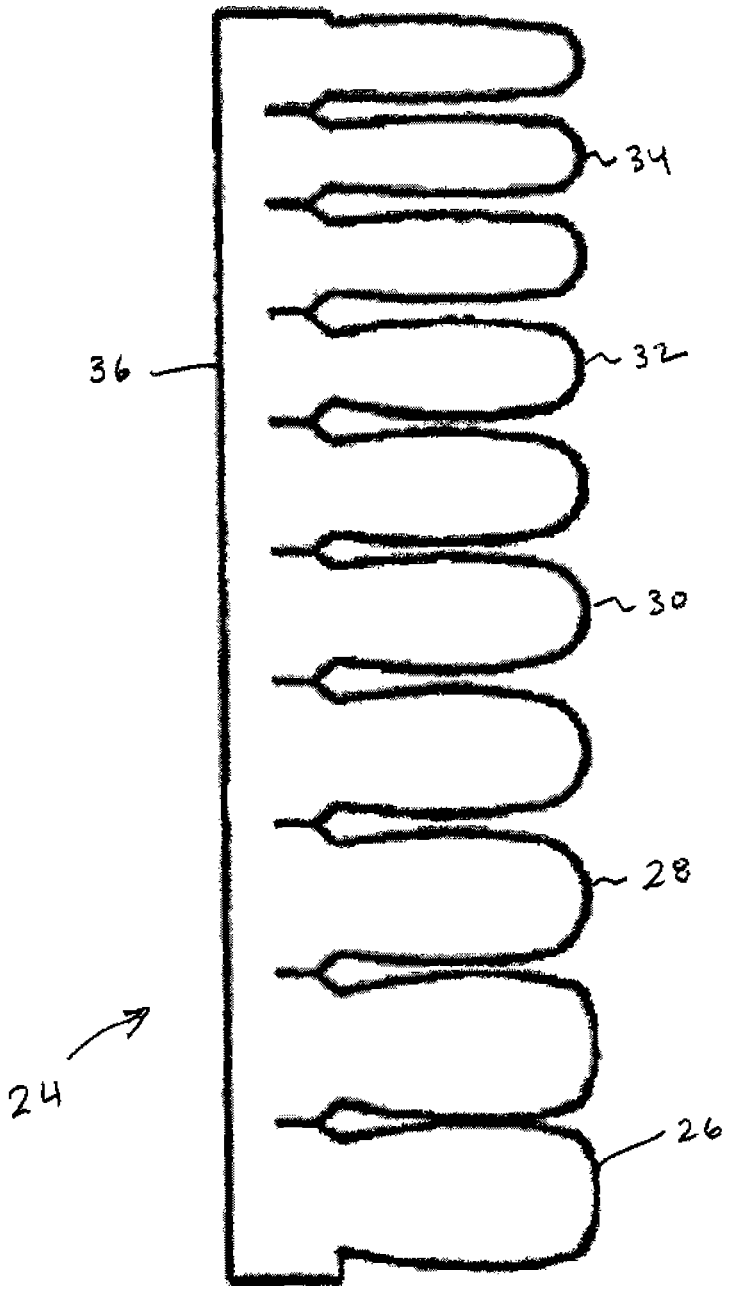
FIG. 2 is a schematic top plan view of a set of foil appliqués after they have been cut from a laminated sheet prepared according to an embodiment of a method of the present invention.

When the top coat 22 of the foil appliqué has been partially-cured, sets of foil appliqués on the substrate 12 are cut from the laminated sheet. FIG. 2 is a schematic top plan view of an exemplary set 24 of foil appliqués made according to the foregoing method. Each set 24 may include appliqués of different sizes, such as appliqués 26, 28, 30, 32, 34, to accommodate nails of different sizes. In some embodiments, the appliqués 26, 28, 30, 32, 34 are integrated with a connector 36.

In some of the embodiments of the invention discussed above, the laminated sheet, and thus the foil appliqués, includes a small amount of solvent to keep the appliqués stretchable until they are used. Thus, the appliqué set 24 is sealed inside a package (not shown) that includes a vapor barrier to prevent the loss of solvent from the appliqués.

To use the foil appliqué, the user opens the package and removes the desired appliqué 26, 28, 30, 32, 34 from the connector 36. The user separates the appliqué from its substrate, and applies the adhesive layer 14 (see FIG. 1) to the nail. The user then stretches the appliqué to cover the nail, removes any excess appliqué overhanging the nail, and trims the appliqué to match the end of the nail (e.g., using a nail file). Body heat from the finger or toe completes the curing process, hardening the appliqué. Since the finished appliqué, as provided in the package, is thin (e.g., about 3.5-5.5 mil, or about 0.10-0.15 mm in overall thickness), the residual solvent can evaporate quickly (e.g., in less than an hour, depending on the user's body temperature and environmental conditions). The hardened appliqué can be detached from the nail using conventional nail polish remover.

It will be understood that the embodiments described herein are merely exemplary and that a person skilled in the art may make many variations and modifications without departing from the spirit and scope of the invention. All such variations and modifications are intended to be included within the scope of the invention, as embodied in the appended claims.

I claim:

1. A self-adhesive nail appliqué, comprising:

a first adhesive layer;

a partially-cured nail enamel base coat on said first adhesive layer;

a second adhesive layer on said base coat opposite said first adhesive layer, wherein said second adhesive layer is ultraviolet radiation curable to a gelled or tacky state wherein the base coat provides a mechanical barrier between the first and the second adhesive layer;

a metallic cold-stamped foil layer on said second adhesive layer opposite said second base coat, wherein said metallic foil layer comprises a porous, stretchable metal film with a plastic sheet removed and able to pass ultraviolet radiation through to cure the second adhesive layer;

a partially-cured nail enamel top coat on said metallic foil layer opposite said second adhesive layer; and, wherein said nail appliqué is soft, flexible and stretchable upon application, and dryable after application to a user's nail, and said entire layers are manually separable and tear resistant, and wherein the remaining applique layers remain fully intact.

2. The nail appliqué of claim 1, wherein said base coat, said second adhesive layer, and said top coat are stretchable at substantially the same rates as each other, and said base coat and top coat comprise organic solvent-based nail enamels having viscosities of 1500-4000 centipoise.

3. The nail appliqué of claim 1, wherein said base coat, said second adhesive layer, and said top coat are coextensive with each other in an uncured state, a partially-cured state, and a cured state able to prevent wrinkling or distortion of the metallic foil layer.

4. The nail appliqué of claim 1, wherein said metallic foil layer is a single layer coextensive with said second adhesive layer and said top coat, and said metallic foil layer comprises an aluminum metallic film with a polyethylene terephthalate plastic sheet removed.

5. The nail appliqué of claim 1, wherein said metallic foil layer covers substantially all of the second adhesive layer and is covered by substantially all of said top coat.

6. The nail appliqué of claim 1, wherein said base coat is configured to provide a smooth surface to which said second adhesive layer is adhered.

7. The nail appliqué of claim 1, wherein said second adhesive layer includes about 10-25% polyurethane resin, 1-25% epoxy resin, 1-20% polyacetate resin, and 1-10% photo-initiators and stabilizers.

8. The nail appliqué of claim 1, wherein said metallic foil layer has a thickness in the range of about 10 to about 1000 nm.

9. The nail appliqué of claim 1, wherein said nail appliqué has a thickness in the range of about 0.10 mm to about 0.15 mm.

10. The nail appliqué of claim 1, further comprising a substrate comprising a thin sheet of silicon-coated release liner or aluminum laminate plastic film, said first adhesive layer being releasably adhered to said substrate.

11. The nail appliqué of claim 1, wherein the partially-cured base coat comprises UV curable nail enamel.

12. The nail appliqué of claim 1, wherein the first adhesive layer, base coat, second adhesive layer are-UV-curable through the porous metallic foil layer.

* * * * *